US006220074B1

(12) United States Patent
Montminy et al.

(10) Patent No.: US 6,220,074 B1
(45) Date of Patent: Apr. 24, 2001

(54) ELECTRICAL CONNECTOR CRIMPING TOOL HEAD

(75) Inventors: Armand T. Montminy, Manchester; Gordon L. Steltzer, New Boston, both of NH (US)

(73) Assignee: FCI USA, Inc., Etters, PA (US)

( * ) Notice: Subject to any disclaimer, the term of this patent is extended or adjusted under 35 U.S.C. 154(b) by 0 days.

(21) Appl. No.: 09/421,583

(22) Filed: Oct. 20, 1999

(51) Int. Cl.[7] ..... B21D 7/00; B21J 9/18

(52) U.S. Cl. ..... 72/454; 72/409.14; 72/416; 29/751; 29/755

(58) Field of Search ..... 72/454, 416, 409.14, 72/451.16; 29/751, 755

(56) References Cited

U.S. PATENT DOCUMENTS

| | | | | |
|---|---|---|---|---|
| 2,285,099 | * | 6/1942 | Specht | 72/454 |
| 2,903,929 | * | 9/1959 | Mcvey | 72/454 |
| 3,260,098 | * | 7/1966 | Gill | 72/454 |
| 3,266,287 | * | 8/1966 | Gill | 72/454 |
| 3,406,558 | * | 10/1968 | Tilmann et al. | 72/409.14 |
| 3,469,434 | * | 9/1969 | Davis | 72/454 |
| 4,796,461 | | 1/1989 | Mead | 72/453.16 |
| 4,942,757 | | 7/1990 | Pecora | 72/453.16 |
| 5,062,290 | | 11/1991 | Hoover | 72/416 |
| 5,727,417 | | 3/1998 | Moffatt et al. | 42/453.03 |

* cited by examiner

*Primary Examiner*—David Jones
(74) *Attorney, Agent, or Firm*—Perman & Green, LLP

(57) ABSTRACT

An electrical connector crimping tool head comprising a frame; and a ram movably connected to the frame. The ram comprises a first member and a second member longitudinally movable along the first member. The first member comprises a shaft section removably insertable into a rotatable drive for a fixed connection to the rotatable drive.

26 Claims, 4 Drawing Sheets

ELECTRICAL CONNECTOR CRIMPING TOOL HEAD

BACKGROUND OF THE INVENTION

1. Field of the Invention

The present invention relates to electrical connector crimping tools and, more particularly, to a tool head for connection to a rotatable drive.

2. Prior Art

U.S. Pat. Nos. 4,942,757 and 5,062,290 disclose hydraulic crimping presses for electrical connectors. The tool heads include a general C-shaped frame, a ram movably connected to the frame, and dies for compressing or crimping an electrical connector.

SUMMARY OF THE INVENTION

In accordance with one embodiment of the present invention, an electrical connector crimping tool head is provided comprising a frame; and a ram movably connected to the frame. The ram comprises a first member and a second member longitudinally movable along the first member. The first member comprises a shaft section removably insertable into a rotatable drive for a fixed connection to the rotatable drive.

In accordance with another embodiment of the present invention, an electrical connector crimping tool head is provided comprising a frame; and a ram movably connected to the frame. The ram comprises a first member and a second member movably connected to the first member. The first member is rotatably connected to the frame in a substantially fixed longitudinal position. The second member is longitudinally movable on the first member as the first member is rotated relative to the frame.

In accordance with another embodiment of the present invention, an electrical connector crimping tool head is provided comprising a frame; and a ram movably connected to the frame. The ram comprises a first member rotatably connected to the frame and a second member movably connected to the first member and the frame. The second member comprises a section connected to the frame for preventing the second member from rotating relative to the frame.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
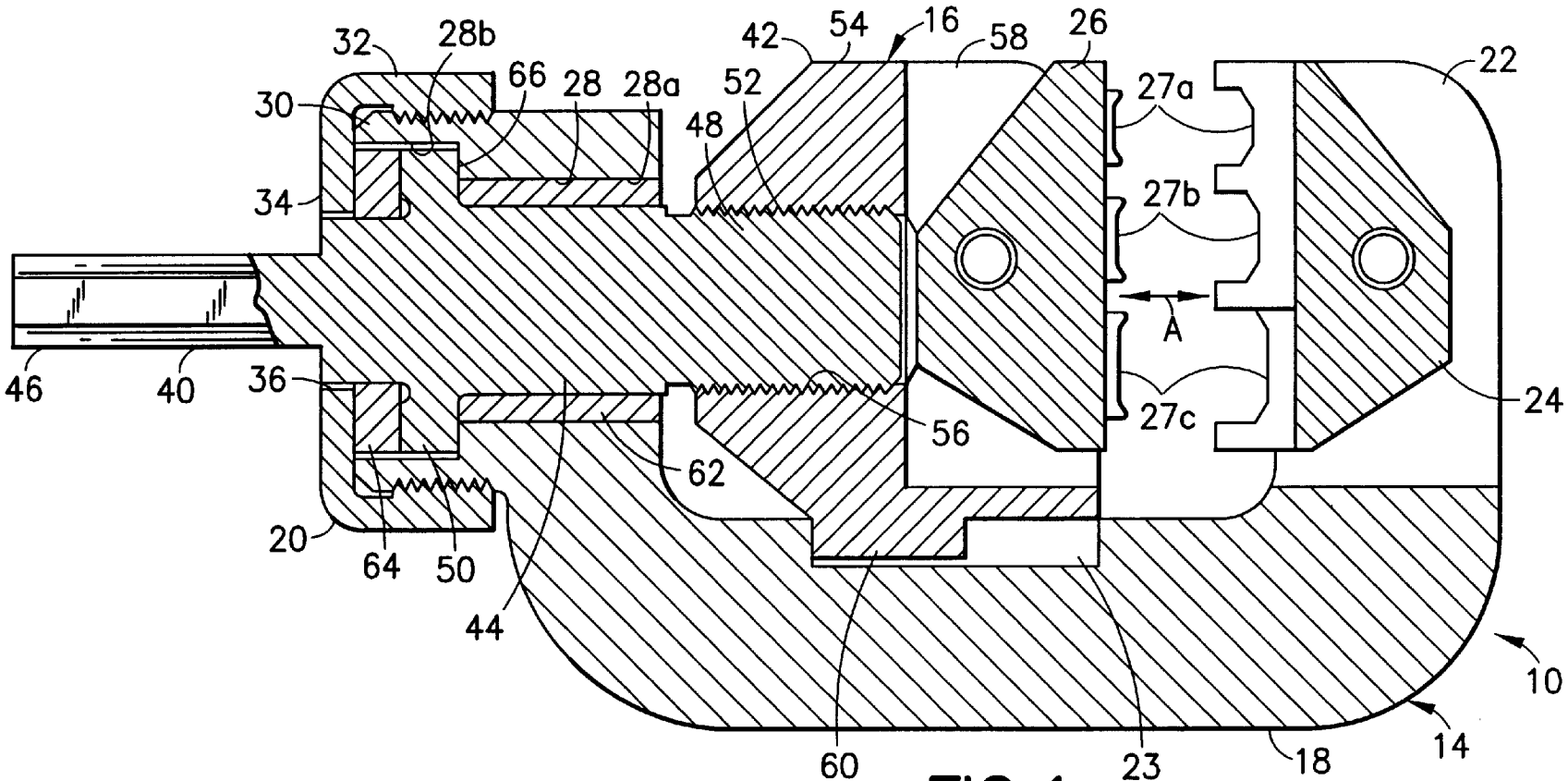
FIG. 1 is a cross-sectional view of an electrical connector crimping tool head incorporating features of the present invention.

Referring to FIG. 1, there is shown cross-sectional view of a tool head 10 incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

In this embodiment the tool head 10 is for compressing or crimping electrical connectors (not shown) onto conductors (not shown). However, in alternate embodiments, the tool head could be configured as a cutting device with cutting blades instead of crimping dies. In this embodiment the tool head 10 is adapted to be removably connected to a drive, such as the drive unit 12 shown in FIG. 2. However, in an alternate embodiment the tool head 10 could be non-removably connected to a suitable drive.

The tool head 10 generally comprises a frame 14 and a ram 16. The frame 14 generally comprises a first frame member 18 and a second frame member 20. In this embodiment the first frame member 18 has a general C-shaped profile. However, in alternate embodiments any suitable shape could be provided. The interior side of the middle of the first frame member 18 includes a slot 23. The top of the first frame member 18 has an area 22 for removably receiving a first crimping die 24. A second crimping die 26 is removably connected to the ram 16. However, in alternate embodiments, the dies 24, 26 could be fixedly, non-removably connected to the first frame member 18 and the ram 16, respectively. In another alternate embodiment the dies need not be provided, such as when electrical connectors are crimped directly by and between surfaces of the frame and ram. In another alternate embodiment the dies 24, 26 could be cutting dies having cutting blades. In this embodiment each of the dies 24, 26 have three crimping areas 27*a*, 27*b*, 27*c* for crimping three different sized electrical connectors. However, the dies could have more or less than three crimping areas. The bottom of the first frame member 18 includes an aperture 28 and a flange 30 with threads. The second frame member 20 has a general cap shape with a flange 32 having interior threads and an end 34. The end 34 comprises an aperture 36. The second frame member 20 is attached to the first frame member 18 by the threads at the flanges 30, 32. However, in alternate embodiments, any suitable means could be used to connect the two frame members to each other.

The ram 16 generally comprises a first ram member 40 and a second ram member 42. The first ram member 40 generally comprises a center section 44, a first end 46 and an opposite second end 48. The first end 46 is preferably provided as a shaft section with a general polygon cross-section. However, the first end 46 could have any suitable shape. The center section 44 includes an annular flange 50. The second end 48 comprises screw threads 52 on an exterior side. The second ram member 42 generally comprises a main section 54 having an aperture 56, a die receiving area 58, and a laterally extending section 60. The aperture 56 is threaded. The second end 48 of the first ram member 40 extends into the aperture 56 and its threads 52 engage the threads of the aperture 56. The die 26 is removably connected to the second ram member 42 at the die receiving area 58. The laterally extending section 60 extends into the slot 23 of the first frame member 18. The section 60 is smaller in height than the slot 23 such that the section 60 can move up and down in the slot.

The center section 44 of the first ram member 40 is located in the apertures 28, 36 of the frame members 18, 20. A first bearing 62 is located between the center section 44 and the first frame member 18 at a narrow section 28*a* of the aperture 28. A second bearing 64 is located between the annular flange 50 of the first frame member 40 and the inside surface of the end 34 of the second frame member 20 inside a larger section 28*b* of the aperture 28. The annular flange 50 of the first ram member 40 is located in the larger section 28*b* of the aperture 28 against a containment surface 66. The annular flange 50 is captured between the containment surface 66 on one side and the bearing 64 and end 34 of the second frame member 20 on the other side. The first ram member 40 is, thus, substantially prevented from longitudinally moving relative to the frame 14. However, the first ram member 40 is axially rotatable relative to the frame 14. In alternate embodiments any suitable connection of the first ram member to the frame could be provided.

As noted above, the two ram members 40, 42 are connected to each other by screw threads. The connection of the second ram member 42 to the first frame member 18, by means of the laterally extending section 60 extending into the slot 23, prevents the second ram member 42 from axially rotating relative to the first frame member 18. Also as noted above, the first ram member 40 is longitudinally constrained relative to the frame 18. Thus, when the first ram member 40 is axially rotated, the second ram member moves along the threads 52 of the first ram member 40 to longitudinally move relative to the frame 14 as indicated by arrow A. Rotation of the first ram member 40 in a first direction will move the die 26 towards the die 24. Rotation of the first ram member 40 in an opposite second direction will move the die 26 away from the die 24. In an alternate embodiment any suitable rotation-to-translation connection could be provided between the two ram members, such as a peg and groove connection. In addition, any suitable rotation prevention system could be provided on the second ram member, such as a portion of the frame extending into a slot in the second ram member.

Figure 2:
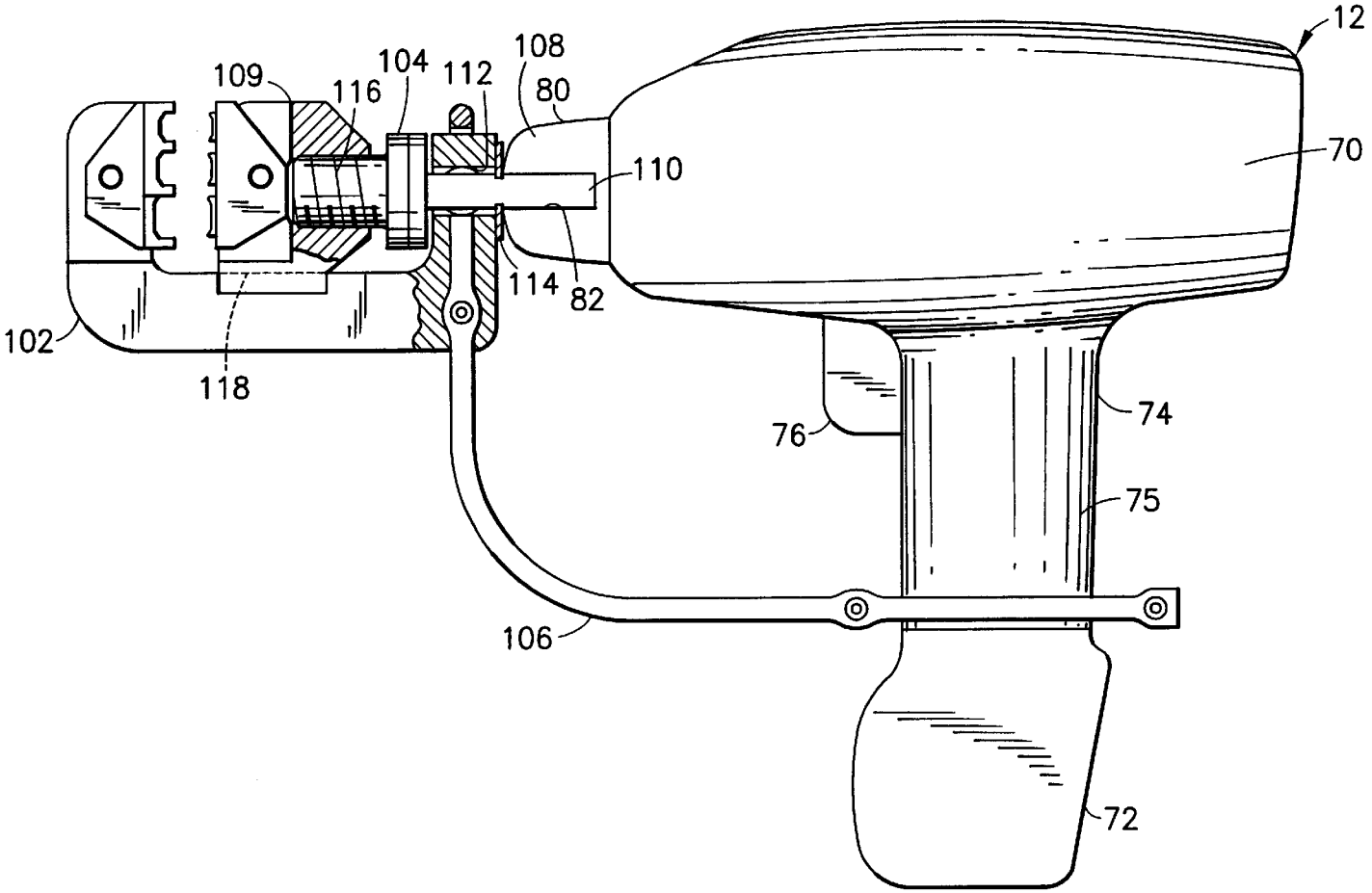
FIG. 2 is a side elevational view with a partial cross-section of another embodiment of the present invention.

The shaft section formed by the end 46 of the first ram member 40 is preferably sized and shaped to be removably received in a receiving hole of a rotatable drive. One embodiment of a drive is shown in FIG. 2. In this embodiment the drive 12 is an electrically powered drill unit comprising an electric motor 70, a battery 72, a housing 74, an activation trigger 76, and a rotatable connector 78 connected to the motor 70. The rotatable connector 78 is adapted to removably receive members to be rotated, such as drill bits. The connector 78 has a receiving hole 80 and a suitable clamping or chuck mechanism for clamping onto a shaft located in the hole 80. Electric powered drill units are readily available in any suitable hardware store or hardware department in a retail store. In one embodiment, the drill unit could be a drill driver which comprises different torque levels or drive modes. Such drive modes could include an overrun mode wherein a clutch type of mechanism disengages when a certain predetermined torque level is obtained. This can help to prevent over-crimping of a connector. In alternate embodiments, any suitable rotatable drive unit could be used, such as a drill unit which is connected by a cord to a main power supply or even a rotatable pneumatically operated drill unit.

One of the advantages of the present invention is the ability to use the tool head 10 with a conventional rotatable drill unit which the customer may already own. Thus, tool head 10 can be sold without its own drive unit thereby reducing the cost of tooling to the customer who already owns a rotatable drill unit. In addition, the present invention allows a user to use a conventional rotatable drill unit both for drilling (with the use of drill bits) and for crimping electrical connectors or cutting conductor by use of the tool head of the present invention.

Referring now to FIG. 2, another embodiment of the present invention will be described. In this embodiment the tool head 100 generally comprises a frame 102, a ram 104, and a stabilizer 106. The stabilizer 106 connects the frame 102 to a handle 75 of the drill unit 12 to prevent the frame 102 from rotating relative to the housing 74. A portion of the stabilizer can extend through a hole in the frame 102 and/or wrap around a bottom portion of the frame. In alternate embodiments any suitable type of stabilization or rotation prevention system could be provided between the frame of the tool head and the drive unit. Any suitable system could be used to connect the shaft section of the ram to the frame. The first ram member 108 can have a shaft section 110 that extends through a single diameter hole 112 of the frame 102 and is longitudinally retained by a spring clip 114. The end 116 has an enlarged diameter to also prevent the member 108 from moving out of the hole. Thus, only a one piece frame is needed rather than a two piece frame as in FIG. 1. The end 116 is threadingly engaged with the second ram member 109. The second ram member 109 has a slot 118 on one side which receives a portion of the frame 102 to prevent the second ram member 109 from rotating relative to the frame 102.

Figure 3A:
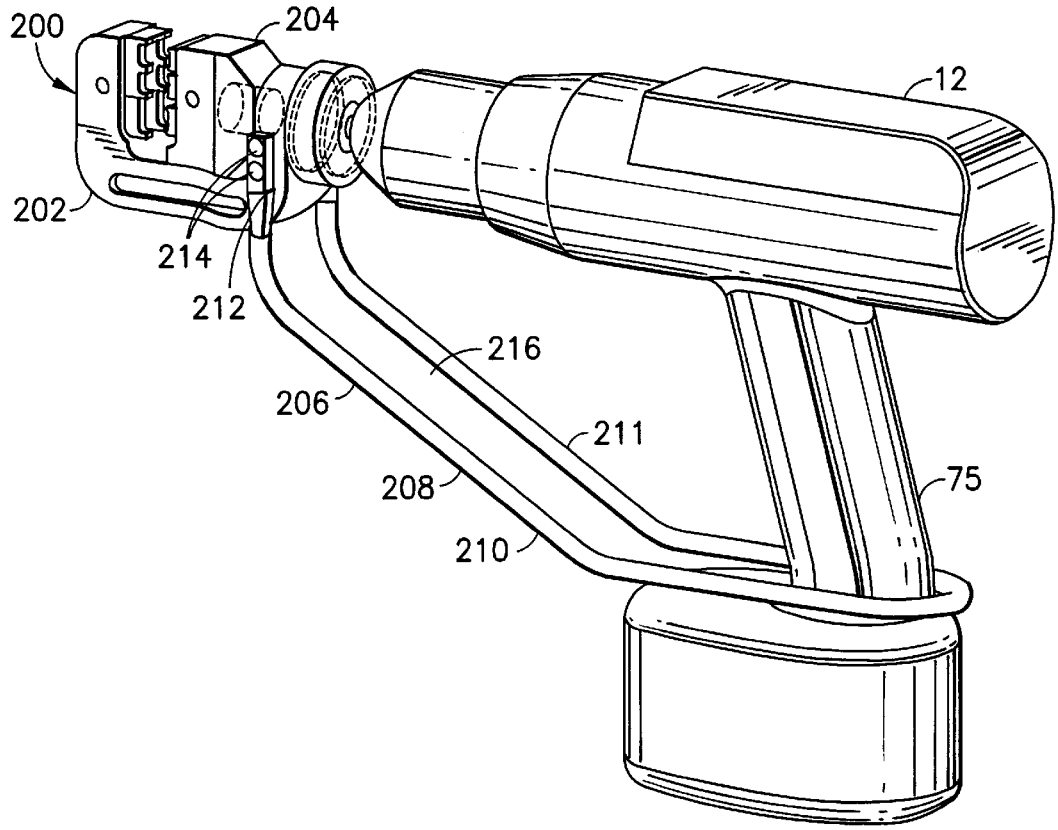
FIG. 3A is a perspective view of an alternate embodiment of the present invention.
Figure 3B:
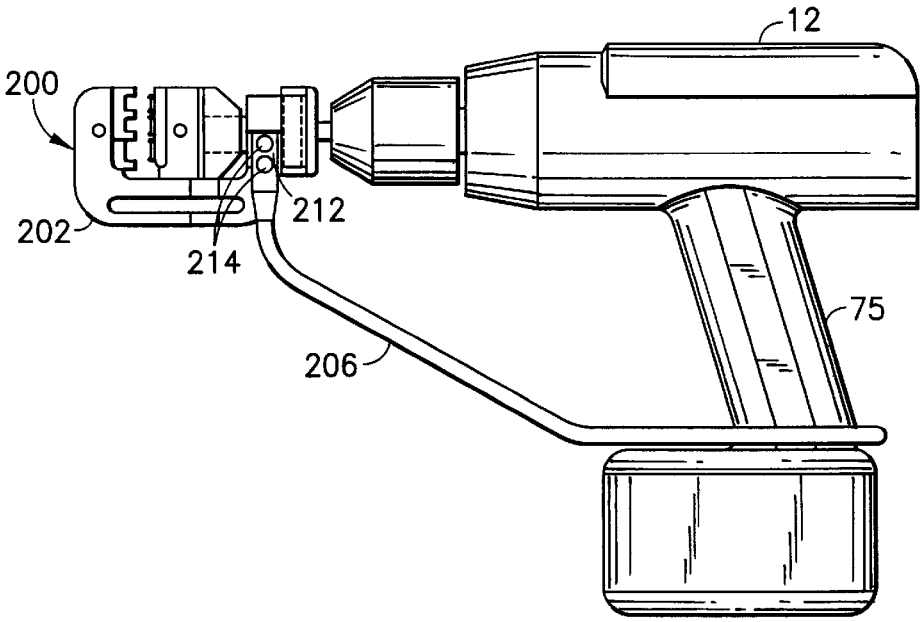
FIG. 3B is a side elevational view of the embodiment shown in FIG. 3A.

Referring now to FIGS. 3A and 3B an alternate embodiment of the present invention is shown. In this embodiment the tool head 200 generally comprises a frame 202, a ram 204, and a stabilizer 206. The stabilizer 206 generally comprises a one-piece bar 208. The bar 208 has a general "U" shape with two spaced bar sections 210, 211. Ends 212 of the bar sections 210, 211 are connected to the frame 202 by fasteners 214, such as screws. The stabilizer 206 receives the handle 75 of the drill unit 12 in the space 216 between the two bar sections 210, 211. Thus, the stabilizer 206 provides an anti-rotation and holding feature which is linked to the distal end of the tool handle. This increases the lever arm to counterbalance the torque. Also, the ease of assembly is increased versus the design shown in FIG. 2 since the linking structure is a simple generally U shaped link designed to be easily inserted on the tool body and attached to the crimping head. Other means could be used to attach the stabilizer bar to the frame, such as force fit insertion or a detent mechanism. The stabilizer solves the problem of the frame spinning with the drive. In addition, the user does not need to hold the frame with his hand to prevent spinning of the frame. This avoids the potential problem of pinching the user's fingers.

Figure 4A:
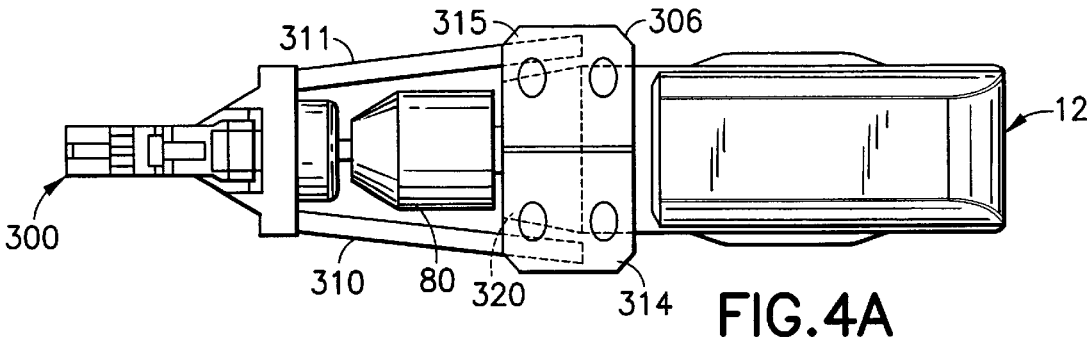
FIG. 4A is a top plan view of another alternate embodiment of the present invention.
Figure 4B:
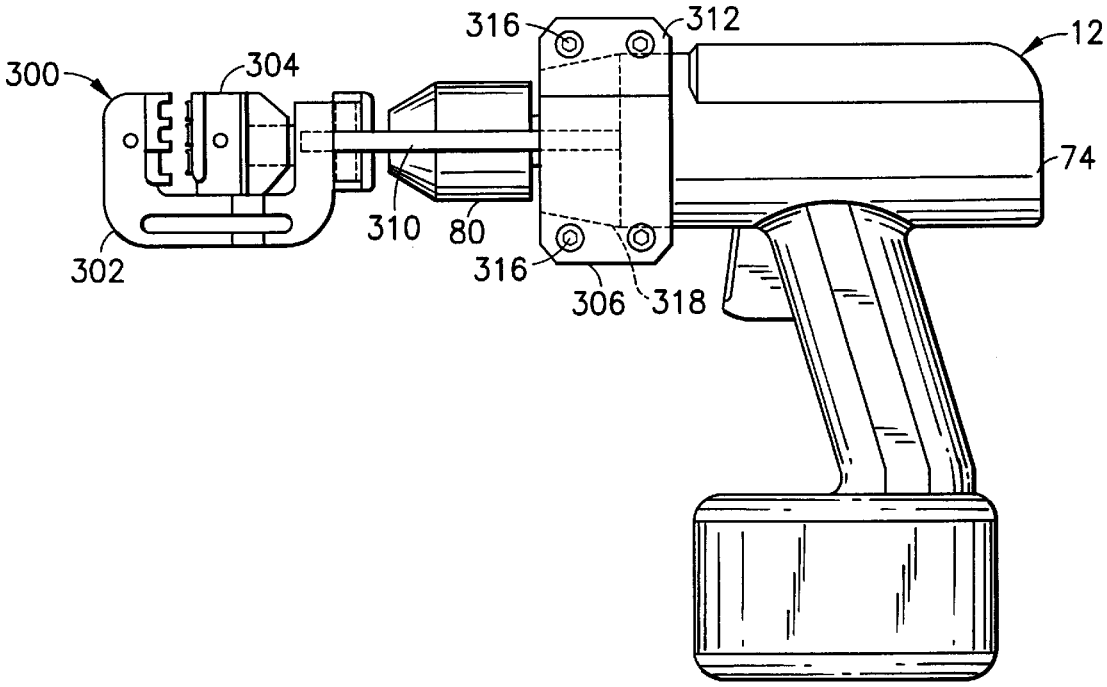
FIG. 4B is a side elevational view of the embodiment shown in FIG. 4A.

Referring now to FIGS. 4A and 4B, an alternate embodiment of the present invention is shown. In this embodiment the tool head 300 generally comprises a frame 302, a ram 304, and a stabilizer 306. The stabilizer 306 generally comprises two bars 310, 311 and a mount 312. The mount 312 generally comprises two members 314, 315 connected to each other by fasteners 316. The mount 312 forms an aperture 318. A resilient bumper 320 could be located in the aperture 318 to directly contact the front of the housing 74 of the drill unit 12 proximate the rotating connector 80. The connection of the mount 312 to the front of the housing 74 prevents the mount from rotating relative to the housing. The rotating connector 80 can pass through the aperture 318 to be connected to the shaft section of the ram 304. The two bars 310, 311 are fixedly connected in holes of the mount 318 and holes in the frame 302. This forms the mount/bars/frame as a rigid structure. Thus, the frame 302 is rigidly connected to the housing 74. This design may allow the system to be fitted on tools having different drive head sizes since the bars may be slidably, non-fixedly connected in the holes of the collar 312. Also, the collar 312 may be made of a hard material adapted to the shape of the housing rotatable behind the drive head or a material with some resilience which could conform itself to the rotatable drive head shape. The collar and anti-rotation bars may be adapted in terms of resilience to absorb part of the end of stroke torque peak.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector crimping tool head comprising:

a frame; and a ram movably connected to the frame, the ram comprising a first member and a second member longitudinally movable along the first member, wherein the first member comprises a shaft section removably insertable into a rotatable drive for a fixed connection to a rotatable connection section of the rotatable drive.

2. A crimping tool head as in claim 1 further comprising a stabilizer connected to the frame, the stabilizer being adapted to contact a portion of the rotatable drive to prevent the frame from rotating relative to the portion of the rotatable drive.

3. A crimping tool head as in claim 2 wherein the stabilizer comprises two spaced stabilizer bar sections extending past a rear end of the shaft section.

4. A crimping tool head as in claim 3 wherein the two bar sections are sized, shaped and spaced relative to each other to receive a portion of a handle of the rotatable drive therebetween when the shaft section is connected to the rotatable connection section of the rotatable drive.

5. A crimping tool head as in claim 4 wherein the stabilizer comprises a single bar comprising the two bar sections.

6. A crimping tool head as in claim 3 wherein the stabilizer further comprises a mount connected to the two bar sections, the mount having an aperture for receiving the portion of the rotatable drive therein.

7. A crimping tool head as in claim 6 wherein the mount comprises a resilient bumper for directly contacting the portion.

8. A crimping tool head as in claim 1 wherein the first member is rotatably connected to the frame.

9. A crimping tool head as in claim 8 wherein the first member is connected to the frame in a substantially fixed longitudinal position.

10. A crimping tool head as in claim 1 wherein the second member is connected to the first member by screw threads.

11. A crimping tool head as in claim 1 wherein the second member is longitudinally movable along the frame and a section of the second member is connected to the frame for preventing the second member from rotating relative to the frame.

12. A crimping tool head as in claim 1 further comprising dies connected to the frame and the second member.

13. A crimping tool head as in claim 12 wherein the dies are removably connected to the frame and the second member.

14. A crimping tool head as in claim 1 wherein the frame comprises a general "C" shaped frame member and a cap frame member connected to the "C" shaped frame member, wherein a portion of the first member is captured between portions of the "C" shaped frame member and the cap frame member, and wherein the first member extends through holes in the "C" shaped frame member and the cap frame member.

15. An electrical connector crimping tool comprising:

a rotatable drive comprising a rotatable connection section having a hole for removably receiving a shaft of a member to be rotated; and a crimping tool head as in claim 1 with the shaft section being removably located in the hole and stationarily connected to the rotatable connection section.

16. An electrical connector crimping tool as in claim 15 wherein the rotatable drive comprises a hand-held portable electric drill unit.

17. An electrical connector crimping tool head comprising:

a frame; and a ram movably connected to the frame, the ram comprising a first member and a second member movably connected to the first member, the first member being rotatably connected to the frame in a substantially fixed longitudinal position, and the second member being longitudinally movable on the first member as the first member is rotated relative to the frame.

18. A crimping tool head as in claim 17 wherein a connection between the first and second members comprises screw threads.

19. A crimping tool head as in claim 17 wherein the second member comprises a section connected to the frame for preventing the second member from rotating relative to the frame.

20. A crimping tool head as in claim 17 wherein the first member comprises a shaft which extends out of the frame and comprises a general polygonal cross-section.

21. A crimping tool head as in claim 17 further comprises crimping dies removably connected to the second member and the frame.

22. A crimping tool head as in claim 17 wherein the frame comprises a general "C" shaped frame member and a cap frame member connected to the "C" shaped frame member, wherein a portion of the first member is captured between portions of the "C" shaped frame member and the cap frame member, and wherein the first member extends through and out of holes in the "C" shaped frame member and the cap frame member.

23. An electrical connector crimping tool comprising:

a rotatable drive comprising a connection section having a hole for removably receiving a shaft of a member to be rotated; and a crimping tool head as in claim 17 with a shaft section of the first member being removably located in the hole and stationarily connected to the connection section.

24. An electrical connector crimping tool head comprising:

a frame; and a ram movably connected to the frame, the ram comprising a first member rotatably connected to the frame and a second member movably connected to the first member and the frame, the second member comprising a section connected to the frame for preventing the second member from rotating relative to the frame, wherein the first and second members are connected to each other by screw threads.

25. A crimping tool head as in claim 24 wherein the first member comprises a shaft having a general polygon cross-section.

26. A crimping tool head as in claim 24 wherein the frame comprises a slot and the section of the second member extends into the slot.

* * * * *